United States Patent [19]

Pedain et al.

[11] 4,248,910

[45] Feb. 3, 1981

[54] REVERSE COATING TEXTILES WITH POLYURETHANE SOLUTIONS

[75] Inventors: Josef Pedain, Cologne; Wilhelm Thoma, Leverkusen, both of Fed. Rep. of Germany

[73] Assignee: Bayer Aktiengesellschaft, Leverkusen, Fed. Rep. of Germany

[21] Appl. No.: 735,664

[22] Filed: Oct. 26, 1976

Related U.S. Application Data

[63] Continuation of Ser. No. 592,011, Jun. 30, 1975, abandoned.

[30] Foreign Application Priority Data

Jul. 2, 1974 [DE] Fed. Rep. of Germany ..... 2431846

[51] Int. Cl.[3] ..... B05D 5/10

[52] U.S. Cl. ..... 427/208.4; 427/428

[58] Field of Search ..... 427/207-208, 427/208.4

[56] References Cited

U.S. PATENT DOCUMENTS

| | | | |
|---|---|---|---|
| 2,432,075 | 12/1947 | Jennings | 427/207 X |
| 3,428,611 | 2/1969 | Brotherton et al. | 260/30.2 X |
| 3,432,456 | 3/1969 | Oertel et al. | 260/30.2 |
| 3,484,274 | 12/1967 | McCarthy | 427/207 X |
| 3,867,350 | 2/1975 | Pedain et al. | 260/77.5 AM |

*Primary Examiner*—Bernard D. Pianalto

*Attorney, Agent, or Firm*—Gene Harsh; Lawrence S. Pope

[57] ABSTRACT

This invention relates to the coating of sheet-form textile materials by the reverse process using polyurethanes which, for ecological and economic reasons, are dissolved in a single organic solvent.

Segmented, substantially linear polyurethanes of dihydroxy polyesters and/or dihydroxy polyethers, aromatic and/or aliphatic diisocyanates and glycols and/or diamines as chain extenders, are used as surface and adhesive coatings in the form of solutions containing only a single organic solvent. To control coating properties, solutions used for adhesive coatings contain from 1 to 15% by weight based on the weight of the solution of water in addition to the organic solvent.

8 Claims, No Drawings

REVERSE COATING TEXTILES WITH POLYURETHANE SOLUTIONS

This is a continuation of application Ser. No. 592,011 filed June 30, 1975 and now abandoned.

BACKGROUND OF THE INVENTION

It has long been known that textiles, such as woven fabrics, knitted fabrics and non-woven fabrics, may be coated with solutions of polyester urethanes by the direct or by the reverse coating processes. The articles obtained are used in the production of outer clothing, upholstery, travel goods, shoe uppers, tarpaulins, blinds, and numerous other products.

In contrast to the two-component polyurethanes which have been known for some time, the so-called "one-component polyurethanes" are fairly recent developments. These products are obtained by reacting polyhydroxyl compounds, especially dihydroxy polyesters or dihydroxy polyethers in admixture with glycols, preferably ethylene glycol or 1,4-butane diol, with aromatic diisocyanates, preferably 4,4'-diphenyl methane diisocyanate. These substantially linear polyurethanes which may be produced both in the melt and in solution are only soluble in solvent mixtures containing dimethyl formamide or other strongly polar compounds, such as dimethyl acetamide or N-methyl pyrrolidone, in quantities of about 20 to 60%, based on the solvent as a whole. The solutions of the one-component polyurethanes have an almost unlimited pot life.

In this case, film formation is merely a physical process which, in contrast to the two-component polyurethanes, is not accompanied by any chemical reaction.

In addition to the use of glycols, such as butane diol, as chain extenders for the production of one-component polyurethanes, the use of diol urethanes, diol amides and diol ureas for producing the hard segments in polyurethanes is also known in the prior art (U.S. Pat. No. 3,388,100).

In addition to the so-called "aromatic" one-component polyurethanes synthesized from aromatic diisocyanates, the so-called "aliphatic" one-component polyurethanes are also known in the prior art. Polyurethanes of this type are polyurethane ureas of relatively high molecular weight dihydroxy compounds, aliphatic isocyanates and aliphatic diamines as chain extenders. In addition, bis-hydrazides, bis-semicarbazides and bis-carbazinic acid esters may also be used as chain extenders.

One-component polyurethanes of dihydroxy polyesters and/or dihydroxy polyethers, aromatic diisocyanates, diols and/or aromatic diamines and/or bis-hydrazides, are used in the form of 20 to 40% solutions in solvent mixtures which always contain large proportions of dimethyl formamide for the production of surface and adhesive coatings by the reverse coating process. One-component polyurethanes based on aliphatic diisocyanates and aliphatic diamines are applied from solvent mixtures which contain secondary or primary alcohols in addition to aromatic hydrocarbons.

Polyurethane elastomers may also be coated onto textile substrates by melt extrusion and may even be processed in the form of aqueous dispersions or in the form of dry sintering powders for textile coating purposes. However, coating with solutions is by far the most widely used prior art process.

According to the prior art, the solvent mixtures in which one-component polyurethanes are dissolved may contain water. According to U.S. Pat. No. 3,432,456, for example, water is used as solvent for the chain extender carbodihydrazide, so that the polyurethane solutions described therein contain from 3 to 4% of water.

German Pat. No. 1,300,273 (corresponding to U.S. Ser. No. 396,998), describes the reaction of NCO-prepolymers in water-containing benzene/acetone mixtures with chain extenders. A water content of from 0.01 to 10% by weight based on the weight of the solution, is proposed in DOS No. 2,229,404 for the purposes of lowering the viscosity of polyurethane solutions. Similarly, the presence of water in polyurethane solutions enables viscosity to be controlled (U.S. Pat. No. 3,428,611). According to DOS No. 1,795,245, water is added in order to obtain polyurethane solutions with reproducible viscosity behavior.

The coating of a textile by the reverse coating process is generally carried out as follows:

The surface-coating solution is coated onto a parting paper in a coating machine, for example, by means of a doctor roll. After the first passage through the drying tunnel, the adhesive-coating solution is similarly applied either in a second coating machine or subsequent return of the web, followed by application of the textile and evaporation of the solvent mixture present in the adhesive coating in the drying tunnel. On leaving the drying tunnel, the parting paper and the coated fabric web are wound into rolls separately from one another.

Considerable difficulties may be encountered in this general sequence of reverse coating onto parting paper, making it impossible to obtain a technically satisfactory coated textile web. When the adhesive-coating solution, which may contain both a one-component polyurethane and also a two-component polyurethane, is applied to the dry, approximately 0.1 mm thick surface coating film, the so-called "frost flower effect" frequently occurs. This descriptive expression is used for the following phenomenon:

If the solvent mixture of the adhesive coating is a poor solvent for the polyurethane of the surface coating, the surface coating swells rather than dissolves. The result of swelling is that, at numerous places over the surface of the web, the surface-coating film is separated from the parting paper, but remains adhering to it at other places. This swelling phenomenon, beginning simultaneously at several places, covers the entire surface in a matter of seconds like freezing frost flowers on a cold window, and makes it unusable for further processing.

According to the prior art, the frost flower effect is counteracted by specifically adjusting the solvent mixture of the adhesive coating (generally dimethyl formamide, methyl ethyl ketone and/or toluene, ethyl acetate, etc.) in its dissolving power to the solubility of the polyurethane used for surface coating. In practice, this generally involves increasing the dimethyl formamide content of the adhesive-coating solution in order to increase its dissolving power. If the solvent mixture of the adhesive coating contains enough effective solvent, for example, 30 to 60% of dimethyl formamide, the surface coating is not swollen, but lightly dissolved, thereby suppressing the frost flower effect.

If, on the other hand, the dissolving power of the adhesive-coating solution is too great for the surface coating, the so-called "break-through" effect is observed. The already dry surface coating is dissolved by the solvent mixture used for the adhesive coating to such an extent that the web of textile material applied is forced through both layers of polyurethane, with the result that the textile structure, for example pile, is visible on the top of the coating. An adhesive-coating solution always has too high a dissolving power for the surface coating when it contains too much, or nothing but, dimethyl formamide or other polar solvents.

The protection of the environment by the reduction of atmospheric pollution by the combustion or recovery of organic solvents in industrial processes, such as the coating of textiles with polyurethane solutions, is an acute industrial problem.

The ecologically necessary recovery of solvent from the textile coating process may only be carried out rationally and economically if, contrary to the prior art, the polyurethane solutions contain a single solvent as opposed to solvent mixtures, such as dimethyl formamide/methyl ethyl ketone, dimethyl formamide/-methyl ethyl ketone/toluene, toluene/isopropanol, etc.

SUMMARY OF THE INVENTION

On account of the solubility behavior of polyurethanes, the only solvents which could be used as single solvents are polar solvents, such as dimethyl formamide, dimethyl acetamide, monomethyl formamide, monomethyl acetamide, N-methyl pyrrolidone, tetrahydrofuran or methyl ethyl ketone. According to the invention, the extremely troublesome "break-through" effect, i.e. the heavy dissolution of the surface layer by the adhesive-coating solvent, is avoided by a water content of about 1 to 15% by weight preferably about 2 to 10% by weight based on the weight of the solution in the adhesive-coating solution.

Accordingly, the invention relates to a process for coating sheet-form textile substrates, such as woven fabrics, knitted fabrics and non-woven fabrics, by reverse coating using polyurethane solutions, followed by recovery of the solvent, which is distinguished by the fact that the surface-coating and adhesive-coating solutions only contain one organic solvent, and coating behavior is controlled by a water content of about 1 to 15% by weight preferably from about 2 to 10% by weight based on the weight of the solution in the adhesive-coating solution.

DETAILED DESCRIPTION OF THE INVENTION

The polyurethanes in the surface-coating and adhesive-coating solutions, which contain only one organic solvent, are so-called aromatic polyurethanes or aliphatic polyurethanes which may be obtained in known manner. It is possible to use one-component polyurethanes which are not subjected to a cross-linking reaction. However, they may also be polyurethanes of the type which may be crosslinked, for example, with formaldehyde resins with acid catalysis.

The polyurethanes may be prepared in known manner either in the melt or in solution both by the one-shot process and also by way of a prepolymer.

Suitable dihydroxy polyesters and/or dihydroxy polyethers are, preferably, those with molecular weights of from about 600 to 4000 and, particularly those with molecular weights of from about 800 to 2500.

The dihydroxy polyesters are obtained in known manner from one or more dicarboxylic acids, preferably containing at least six carbon atoms, or one or more dihydric alcohols.

Instead of using the free polycarboxylic acids, it is also possible to use the corresponding polycarboxylic acid anhydrides or esters of lower alcohols or mixtures thereof for producing the polyesters. The polycarboxylic acids may be aliphatic, cycloaliphatic, aromatic and/or heterocyclic and may optionally be substituted, for example by halogen atoms, and/or be unsaturated. Examples of such polycarboxylic acids are: succinic acid, pimelic acid, adipic acid, suberic acid, azelaic acid, sebacic acid, phthalic acid, isophthalic acid, trimellitic acid, phthalic acid anhydride, tetrahydrophthalic acid anhydride, hexahydrophthalic acid anhydride, tetrachlorophthalic acid anhydride, endomethylene tetrahydrophthalic acid anhydride, glutaric acid anhydride, maleic acid, maleic acid anhydride, fumaric acid, dimeric and trimeric fatty acids, such as oleic acid, optionally in admixture with monomeric fatty acids, terephthalic acid dimethyl ester or terephthalic acid-bis-glycol ester. It is preferred to use aliphatic dicarboxylic acids, adipic acid being particularly preferred. Examples of dihydric alcohols include: ethylene glycol, 1,2- and 1,3-propylene glycol, 1,4- and 2,3-butylene glycol, 1,3- and 1,6-hexane diol, 1,8-octane diol, neopentyl glycol, 1,4-bis-hydroxy methyl cyclohexane, 2-methyl-1,3-propane diol, also diethylene glycol, triethylene glycol, tetraethylene glycol, polyethylene glycols, dipropylene glycol, polypropylene glycols, dibutylene glycol and polybutylene glycols.

In addition to polyesters of this type, it is also possible to use hydroxy polycarbonates, especially those of 1,6-hexane diol and diaryl carbonates, for producing the polyurethanes used in accordance with the invention. Polycondensation products of straight-chain hydroxy alkane monocarboxylic acids containing at least 5 carbon atoms, for example $\epsilon$-hydroxy caproic acid, and the corresponding lactone polymers, may also be used in accordance with the invention.

The polyethers containing two hydroxyl groups suitable for use in accordance with the invention are also known and are obtained, for example, by polymerizing epoxides, such as ethylene oxide, propylene oxide, butylene oxide, tetrahydrofuran, styrene oxide or epichlorohydrin on their own, for example in the presence of $BF_3$, or by the chemical addition of these epoxides, optionally in admixture or successively with starter components containing reactive hydrogen atoms, such as alcohols or amines, for example water, ethylene glycol, 1,2-propylene glycol or 1,3-propylene glycol, 4,4'-dihydroxy diphenyl propane, aniline, ethanolamine or ethylene diamine.

It is particularly preferred to use dihydroxy butylene glycol polyethers and dihydroxy propylene glycol polyethers.

Other starting components suitable for use in accordance with the invention are aliphatic, cycloaliphatic, araliphatic, aromatic and heterocyclic polyisocyanate of the type described, for example, by W. Siefken in Justus Liebigs Annalen der Chemie, 562, pages 75 to 136, for example ethylene diisocyanate, 1,4-tetramethylene diisocyanate, 1,6-hexamethylene diisocyanate, 1,12-dodecane diisocyanate, cyclobutane-1,3-diisocyanate, cyclohexane-1,3- and -1,4-diisocyanate, also mixtures of these isomers, 1-methyl-2,6-diisocyanatocyclohexane, 1-methyl-2,4-diisocyanatocyclohexane, 1-isocyanato-3,3,5-trimethyl-5-isocyanatomethyl cyclohexane, 2,4- and 2,6-hexahydrotolylene diisocyanate, also mixtures of these isomers, hexahydro-1,3- and/or -1,4-phenylene diisocyanate, perhydro-2,4'- and/or -4,4'-diphenyl methane diisocyanate, 1,3- and 1,4-phenylene diisocyanate, 2,4- and 2,6-tolylene diisocyanate, also mixtures of these isomers, diphenyl methane-2,4'- and/or -4,4'-diisocyanate, naphthylene-1,5-diisocyanate or 4,4'-diphenyl dimethyl methane diisocyanate, and also mixtures of these compounds. 4,4'-diphenyl methane diisocyanate is particularly suitable.

The low molecular weight diol components, which are used as chain extenders in the production of the polyurethanes used in accordance with the invention, preferably have molecular weights of from about 62 to 450. According to the invention, it is possible to use a variety of different types of diol compounds, for example:

(a) alkane diols, such as ethylene glycol, 1,3-propylene glycol and 1,2-propylene glycol, 1,4-butane diol, 1,5-pentane diol, dimethyl-1,3-propane diol and 1,6-hexane diol;

(b) ether diols, such as diethylene glycol, triethylene glycol or 1,4-phenylene-bis-(β-hydroxy ethyl ether);

(c) amino diols, such as N-methyl diethanolamine or N-methyl dipropanolamine;

(d) ester diols corresponding to one of the general formulae:

$$HO-(CH_2)_x-CO-O-(CH_2)_y-OH$$

and $$HO-(CH_2)_x-O-CO-R-CO-O-(CH_2)_x-OH$$

wherein

R represents an alkylene or arylene radical with 1 to 10, preferably 2 to 6 carbon atoms;

x=2–6; and y=3–5;

for example, δ-hydroxy butyl-ε-hydroxy caproic acid ester, ω-hydroxy hexyl-γ-hydroxy butyric acid ester, adipic acid-(β-hydroxy ethyl) ester and terephthalic acid-bis-(β-hydroxy ethyl) ester.

(e) diol urethanes corresponding to the general formula:

$$HO-(CH_2)_x-O-CO-NH-R'-NH-CO-O-(CH_2)_x-OH$$

wherein

R' represents an alkylene, cycloalkylene or arylene radical with 2 to 15, preferably 2 to 6 carbon atoms; and x is a number from 2 to 6;

for example, 1,6-hexamethylene-bis-(β-hydroxy ethyl urethane) or 4,4'-diphenyl methane-bis-(β-hydroxy butyl urethane);

(f) diol ureas corresponding to the general formula:

$$HO-(CH_2)_x-\underset{\underset{R'''}{|}}{N}-CO-NH-R''-NH-CO-\underset{\underset{R'''}{|}}{N}-(CH_2)_x-OH$$

wherein

R'' represents an alkylene, cycloalkylene, or arylene radical with 2 to 15, preferably 2 to 9 carbon atoms;

R'''=H or $CH_3$; and x=2–3;

for example, 4,4'-diphenyl methane-bis-(β-hydroxy ethyl urea) or the compound:

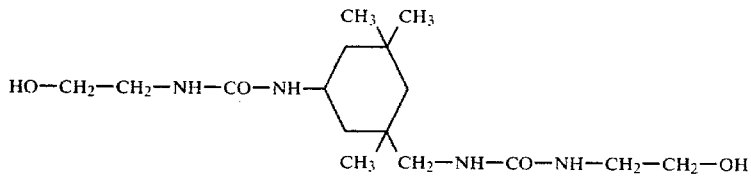

Examples of aliphatic diamines which may be used individually or in admixture as chain extenders in accordance with the invention are: ethylene diamine, 1,2- and 1,3-propylene diamine, 1,4-tetramethylene diamine, 1,6-hexamethylene diamine, N,N'-diisobutyl-1,6-hexamethylene diamine, 1,11-undecamethylene diamine, 1,12-dodecamethylene diamine, cyclobutane-1,3-diamine, cyclohexane-1,3- and -1,4-diamine and mixtures thereof, 1-amino-3,5,5,-trimethyl-5-aminomethyl cyclohexane, 2,4- and 2,6-hexahydrotolylene diamine and mixtures thereof, perhydro-2,4'- and 4,4'-diaminodiphenyl methane, p-xylylene diamine, bis-(3-aminopropyl)-methyl amine, etc. Hydrazine and substituted hydrazines, for example methyl hydrazine, N,N'-dimethyl hydrazine and their homologues, may also be used in accordance with the invention as may acid dihydrazides, for example, carbodihydrazide, oxalic acid dihydrazides, the dihydrazides of malonic acid, succinic acid, glutaric acid, adipic acid, β-methyl adipic acid, sebacic acid, hydracrylic acid and terephthalic acid, semicarbazido-alkylene-hydrazides, such as, β-semicarbazido propionic acid hydrazide (DOS No. 1,770,591 corresponding to U.S. Ser. No. 830,128), semicarbazido-alkylene-carbazinic acid esters, such as, 2-semicarbazido-ethyl-carbazinic acid ester (U.S. Pat. No. 3,635,070), or even amino semicarbazide compounds, such as β-aminoethyl semicarbazido carbonate (U.S. Pat. No. 3,658,746).

Examples of aromatic diamines are: bis-anthranilic acid esters according to German Offenlegungsschrift Nos. 2,040,644 and 2,160,590 (U.S. Ser. Nos. 171,381 and 306,783), 3,5- and 2,4-diaminobenzoic acid esters according to U.S. Pat. No. 3,794,621, the diamines containing ester groups described in U.S. Pat. No. 3,736,350 and in, German Offenlegungsschrift Nos. 2,040,650 and 2,160,589 (U.S. Ser. Nos. 171,318 and 307,734), also 3,3'-dichloro-4,4'-diaminodiphenyl methane, tolylene diamine, 4,4'-diaminodiphenyl methane and 4,4'-diaminodiphenyl disulphide.

In addition to one-component polyurethanes, it is also possible in accordance with the invention to use known two-component systems as adhesive coatings. The systems in question are generally solutions of a mixture of polyurethane prepolymers with terminal OH-groups having a molecular weight of from about 10,000 to 80,000, preferably from about 20,000 to 50,000, polyisocyanates and catalysts. Suitable polyisocyanates, apart from those mentioned above, are compounds with more than two NCO-groups or even reaction products of polyhydroxyl compounds with excess polyisocyanate, for example, a 75% solution in DMF of a polyisocyanate of trimethylol propane and 2,4-tolylene diisocyanate with an NCO-content of free tolylene diisocyanate of less than 0.3%.

The catalysts used in the adhesive-coating solutions are known for example tertiary amines, such as triethyl amine, tributyl amine, N-methyl morpholine, N-ethyl morpholine, N,N,N',N'-tetramethyl ethylene diamine, 1,4-diazabicyclo-(2,2,2)-octane, N-methyl-N'-dimethyl amino ethyl piperazine, N,N-dimethyl benzyl amine, bis-(N,N-diethyl amino ethyl)-adipate, N,N-diethyl benzyl amine, pentamethyl diethylene triamine, N,N-dimethyl cyclohexyl amine, N,N,N',N'-tetramethyl-1,3-butane diamine, N,N-dimethyl-β-phenyl ethyl amine, 1,2-dimethyl imidazole or 2-methyl imidazole.

Tertiary amines containing isocyanate-reactive hydrogen atoms are, for example, triethanolamine, triisopropanolamine, N-methyl diethanolamine, N-ethyl diethanolamine and N,N-dimethyl ethanolamine, also the reaction products thereof with alkylene oxides, such as propylene oxide and/or ethylene oxide.

Other suitable catalysts are silaamines with carbon-silicon bonds, of the type described, for example, in German Pat. No. 1,229,290, for example, 2,2,4-trimethyl-2-silamorpholine and 1,3-diethylaminomethyl tetramethyl disiloxane.

According to the invention, it is also possible to use organometallic compounds, especially organic titanium compounds, as catalysts.

Further representatives of catalysts suitable for use in accordance with the invention and details of the way in which the catalysts work, may be found in Kunststoff-Handbuch, Vol. VII, published by Vieweg and Hochtlen, Carl-Hanser-Verlag, Munich 1966, for example, on pages 96 to 102 and in Polyurethanes: Chemistry and Technology, Part I, by Saunders and Frisch, Interscience Publishers, New York, 1962.

The surface-coating and/or adhesive-coating polyurethanes may be crosslinked with aldehyde-urea or aldehyde-melamine resins, for example, formaldehyde/-melamine resin, formaldehyde/urea resin, melamine/-hexamethylol ether, etc., which react under the catalytic effect of acid-reacting substances, for example, maleic acid, phosphoric acid or 4-toluenesulphonic acid (optionally after buffering with bases, such as ammonia, N-methyl morpholine or triethanolamine). The crosslinking temperatures and times are from about 120° to 150° C. and about 15 to 16 seconds, respectively. They correspond to the drying tunnel temperatures normally used for coating purposes and to the residence times determined by the rate of motion and tunnel length.

Pigments, fillers and other additives, such as hydrolysis stabilizers (e.g. polycarbodiimides), UV-stabilizers, antioxidants such as ionol and poly-siloxanes, may be added to the surface-coating and adhesive-coating solutions in the usual way.

In the process according to the invention the coating steps generally are carried out at about room temperature. The temperature of the drying channels is kept at 70° to 170° C., preferably 80° to 150° C.

The improved coating properties of polyurethane surface coatings with the water-containing adhesive-coating solutions according to the invention, using only one organic solvent are demonstrated in the following Examples. Unless otherwise stated, the figures quoted are parts by weight or percentages by weight.

General Procedure for Coating

The surface-coating solution is applied to a release paper on a coating machine by means of a doctor roll. The solution is applied in a quantity of 120 g per square meter. After the first passage through the drying tunnel, which at its inlet end has an air temperature of 100° C. and its outlet end an air temperature of 140° C., 120 g/m$^2$ of the adhesive-coating solution are similarly applied in the second coating unit or after return of the web, followed by application of the textile web, a roughened cotton-duvetyn fabric weighing 240 g per square meter, and by evaporation in the drying tunnel of the solvent mixture of the adhesive-coating solution.

On leaving the drying tunnel, the release paper and the coated textile web are wound into rolls separately from one another.

EXAMPLE 1

The surface-coating solution D 1 is a 25% solution of a polycarbonate-polyester urethane in dimethyl formamide with viscosity of 10,000 cP at 25° C. The polycarbonate-polyester urethane is obtained by the melt condensation of 1000 g (0.5 mol) of hexane diol polycarbonate, 1125 g (0.5 mol) of a 1,4-butane diol adipate, 270 g of 1,4-butane diol (3.0 mol) and the equivalent quantity of 4,4'-diphenyl methane diisocyanate (1000 g or 4 mols).

The adhesive-coating solution H 1 is a 25% solution of a polyester urethane in dimethyl formamide/water (94:6) with a viscosity of 12,000 cP at 25° C.

The polyester urethane is obtained by the melt condensation of 2250 g (1.0 mol) of a 1,4-butane diol adipate, 216.0 g of 1,4-butane diol (2.4 mol) and the equivalent quantity of 4,4'-diphenyl methane diisocyanate (850 g or 3.4 mols).

The adhesive-coating solution H 2 (comparison) is the 25% solution of the polyester urethane in dimethyl formamide used for H 1 without the water.

| Coating solutions<br>Surface coating/adhesive coating | Condition of the coating |
|---|---|
| D 1/H 1 | no break-through |
| D 1/H 2 (comparison test) | marked break-through |

EXAMPLE 2

The surface-coating solution D 1 described in Example 1 is used for the surface coating.

The adhesive-coating solution H 3 is a 30% solution of a polyester urethane in dimethyl formamide/water (95:5) with a viscosity of 26,000 cP at 25° C. The polyurethane is obtained by the melt condensation of 2000 g (1.0 mol) of a mixed polyester of 1,6-hexane diol, neopentyl glycol and adipic acid, 135.0 g of 1,4-butane diol (1.5 mol) and the equivalent quantity of 4,4'-diphenyl methane diisocyanate (625 g or 2.5 mols).

The adhesive-coating solution H 4 (comparison) is the 30% solution of the polyester urethane in dimethyl formamide used for H 3 without the water added.

| Coating solutions<br>Surface coating/adhesive coating | Condition of the coating |
|---|---|
| D 1/H 3 | no break-through |
| D 1/H 4 (comparison test) | break-through |

EXAMPLE 3

The surface coating solution D 2 is a 30% solution of a segmented polycarbonate-polyurethane urea elastomer in dimethyl formamide with a viscosity of 30,000 cP at 25° C. The polyurethane is obtained by the prepolymer process from 730 g of hexane diol polycarbonate (molecular weight 2000), 180 g of isophorone diisocyanate (1-isocyanato-3-isocyanatomethyl-3,5,5-trimethyl cyclohexane) and 90 g of 4,4'-diaminodicyclohexyl methane. To this end, the NCO-prepolymer prepared in the melt from hexane diol polycarbonate and isophorone diisocyanate is dissolved in DMF and reacted with the diamine solution in DMF to form the polyurethane urea.

The adhesive-coating solution H 5 is a 30% solution of a polyester urethane urea in dimethyl formamide/-water (95:5) with a viscosity of 20,000 cP at 25° C. 300 g of polyurethane granulate are dissolved in 600 g of dimethyl formamide to form a 33.3% solution. A mixture of 50 g of dimethyl formamide and 50 g of water is added to the resulting solution.

The polyurethane is obtained by the prepolymer process from 1700 g (1.0 mol) of a mixed polyester of 1,6-hexane diol, neopentyl glycol and adipic acid, 488 g (2.2 mol) of isophorone diisocyanate and 204 g (1.2 mol) of 1-amino-3-aminomethyl-3,5,5-trimethyl cyclohexane. The NCO-prepolymer condensed in toluene is reacted with the solution of the diamine in isopropanol to form the polyurethane. The solution of the polyurethane elastomer is converted into a granulate in an evaporation screw, the toluene/isopropanol solvent being removed by distillation.

The adhesive-coating solution H 6 (comparison) is the 30% solution of the polyurethane urea granulate in dimethyl formamide used for H 5 without the water added.

| Coating solutions<br>Surface coating/adhesive coating | Condition of coating |
|---|---|
| D 2/H 5 | no break-through |
| D 2/H 6 (comparison test) | break-through |

EXAMPLE 4

The surface-coating solution D 2 described in Example 3 is used as surface coating.

The adhesive-coating solution H 7 is a 30% solution of a polyester urethane granulate in dimethyl formamide/water (93:7) with a viscosity of 24,000 cP at 25° C. The polyurethane granulate is obtained by the melt process from 900 g (1.0 mol) of 1,6-hexane diol adipate and 174 g (1.0 mol) of an isomer mixture of 2,4- and 2,6-tolylene diisocyanate (20:80).

50 g of a 50% melamine resin solution are added as crosslinker to 1000 g of the polyurethane solution, 4.0 g of a 20% solution of 4-toluene sulphonic acid being added as crosslinking catalyst.

The adhesive-coating solution H 8 (comparison) is the 30% solution of the polyurethane in dimethyl formamide used for H 7 without the water added.

| Coating solutions<br>Surface coating/adhesive coating | Condition of coating |
|---|---|
| D 2/H 7 | no break-through |
| D 2/H 8 (comparison test) | break-through |

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. In a process for reverse coating a sheet-form textile substrate with adhesive-coating and surface-coating polyurethane solutions, the improvement comprising preparing the polyurethane solutions using a single organic solvent which is polar and controlling the coating behavior of the adhesive-coating solution by varying its water content between about 1 and 15 weight % based on the weight of the solution.

2. The reverse coating process of claim 1 wherein the single organic polar solvent is selected from the group consisting of dimethyl formamide, dimethyl acetamide, monomethyl formamide, monomethyl acetamide, N-methyl pyrrolidone, tetrahydrofuran and methyl ethyl ketone.

3. The reverse coating process of claim 2 wherein the organic polar solvent in the surface-coating and the adhesive-coating solutions is dimethyl formamide.

4. The reverse coating process of claim 1 wherein the water content of the adhesive coating solution is between about 2 and 10% by weight based on the weight of the solution.

5. The reverse coating process of claim 1 wherein the polyurethanes in solution are segmented, substantially linear and built up from reactants selected from the group consisting of dihydroxy polyesters, dihydroxy polyethers, aromatic diisocyanates, aliphatic diisocyanates, glycols and diamines.

6. The reverse coating process of claim 5 wherein the hydroxy bearing reactants are selected from the group consisting of dihydroxy polyesters of molecular weights of about 800 to 7500, dihydroxy polyethers of molecular weights of about 800 to 7500, dihydroxy polycarbonates of molecular weights of about 800 to 7500 and glycols with molecular weights of about 62 to 450.

7. The reverse coating process of claim 6 wherein the polyethers are selected from the group consisting of dihydroxy butylene glycol polyether and dihydroxy propylene glycol polyether and the polycarbonate is built up from 1,6-hexane diol and diaryl carbonate.

8. The reverse coating process of claim 1 wherein the diisocyanate used to make the polyurethanes in solution is 4,4'-diphenylmethane diisocyanate.

* * * * *